US010087528B2

(12) United States Patent
Mukai

(10) Patent No.: US 10,087,528 B2
(45) **Date of Patent: *Oct. 2, 2018**

(54) PALLADIUM PLATE COATED MATERIAL AND METHOD OF PRODUCING PALLADIUM PLATE COATED MATERIAL

(71) Applicant: TOYO KOHAN CO., LTD., Tokyo (JP)

(72) Inventor: Nobuaki Mukai, Kudamatsu (JP)

(73) Assignee: TOYO KOHAN CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/897,118

(22) PCT Filed: Apr. 21, 2014

(86) PCT No.: PCT/JP2014/061132
§ 371 (c)(1),
(2) Date: Dec. 9, 2015

(87) PCT Pub. No.: WO2014/199727
PCT Pub. Date: Dec. 18, 2014

(65) Prior Publication Data

US 2016/0145746 A1 May 26, 2016

(30) Foreign Application Priority Data

Jun. 13, 2013 (JP) ..... 2013-124696

(51) Int. Cl.
*B32B 15/01* (2006.01)
*C23C 18/50* (2006.01)
(Continued)

(52) U.S. Cl.
CPC ..... *C23C 18/50* (2013.01); *C22C 5/04* (2013.01); *C23C 18/1633* (2013.01);
(Continued)

(58) Field of Classification Search
None
See application file for complete search history.

(56) References Cited

U.S. PATENT DOCUMENTS 3,282,723 A * 11/1966 Melillo ..... C23C 18/28 427/129
3,485,597 A * 12/1969 Pearlstein ..... C23C 18/36 106/1.12
(Continued)

FOREIGN PATENT DOCUMENTS

CA 2 300 008 A1 9/2000
CN 1191392 A 8/1998
(Continued)

OTHER PUBLICATIONS

Office Action dated Nov. 29, 2016 in corresponding Japanese Patent Application No. 2013-124696.
(Continued)

*Primary Examiner* — Seth Dumbris
(74) *Attorney, Agent, or Firm* — Muncy, Geissler, Olds & Lowe, P.C.

(57) ABSTRACT

There is provided a palladium plate coated material (100) comprising: a base material (10); an underlying alloy layer (20) formed on the base material (10); and a palladium plated layer (30) formed on the underlying alloy layer (20). The palladium plate coated material (100) is characterized in that the underlying alloy layer (20) is formed of an M1-M2-M3 alloy (where M1 is at least one element selected from Ni, Fe, Co, Cu, Zn and Sn, M2 is at least one element selected from Pd, Re, Pt, Rh, Ag and Ru, and M3 is at least one element selected from P and B).

7 Claims, 5 Drawing Sheets

(51) Int. Cl.

| | |
|---|---|
| ***C23C 18/44*** | (2006.01) |
| ***C23C 28/02*** | (2006.01) |
| ***C23C 18/16*** | (2006.01) |
| ***C23C 18/48*** | (2006.01) |
| ***C22C 5/04*** | (2006.01) |

(52) U.S. Cl.
CPC ..... *C23C 18/1651* (2013.01); *C23C 18/44* (2013.01); *C23C 18/48* (2013.01); *C23C 28/021* (2013.01)

(56) References Cited

U.S. PATENT DOCUMENTS

| | | | | |
|---|---|---|---|---|
| 3,754,939 | A * | 8/1973 | Pearlstein | C23C 18/48 106/1.22 |
| 5,700,307 | A * | 12/1997 | Kashiwagi | B32B 15/01 249/116 |
| 6,150,711 | A | 11/2000 | Kom et al. | |
| 6,730,415 | B2 * | 5/2004 | Shibuya | A44C 27/006 204/192.16 |
| 6,886,403 | B2 * | 5/2005 | LaBarge | G01F 23/363 73/304 C |
| 2005/0242454 | A1 * | 11/2005 | Yuasa | B29C 33/424 264/2.5 |
| 2011/0031449 | A1 | 2/2011 | Enomoto et al. | |
| 2011/0200842 | A1 | 8/2011 | Uhlig et al. | |
| 2012/0228559 | A1 | 9/2012 | Enomoto et al. | |

FOREIGN PATENT DOCUMENTS

| | | | |
|---|---|---|---|
| CN | 101469420 | A | 7/2009 |
| CN | 102482779 | A | 5/2012 |
| JP | 10-237691 | A | 9/1998 |
| JP | 2001-006713 | A | 1/2001 |
| JP | 2001-093538 | A | 4/2001 |
| JP | 2008-004498 | A | 1/2008 |
| JP | 2008-208387 | A | 9/2008 |
| JP | 2010-090402 | A | 4/2010 |
| JP | 2011-175951 | A | 9/2011 |
| JP | 2012-505964 | A | 3/2012 |

OTHER PUBLICATIONS

An Office Action from corresponding CN Application No. 201480033644.9 dated Jan. 5, 2017; 14 pgs.

A EP Search Report from corresponding Application No. 14811652.8 dated Jan. 3, 2017; 6 pgs.

Japanese Office Action dated Apr. 11, 2017 in corresponding Application No. 2013-124696.

Chinese Office Action (w/English-translation) dated Sep. 1, 2017 in corresponding CN Application No. 20148003644.9 (9 pages).

Chinese Office Action (w/English-language translation) dated Mar. 9, 2018 in CN Application No. 201480033644.9 (10 pages).

* cited by examiner (A) Before palladium plating (B) Example 1

(C) Example 2

(D) Example 3

(E) Example 4

*Examples each show the concentration of dissolved ions (Ni, Pd, P, Fe, Cr, and Mo), while SUS316L shows the concentration of dissolved ions (Fe, Cr, Mo, and Ni).

PALLADIUM PLATE COATED MATERIAL AND METHOD OF PRODUCING PALLADIUM PLATE COATED MATERIAL

BACKGROUND OF THE INVENTION

1. Technical Field of the Invention

The present invention relates to a palladium plate coated material and a method of producing a palladium plate coated material.

2. Description of the Related Art

As an electrical contact material such as used for connectors, switches or printed wiring boards, there has conventionally been used a member configured such that the surface of a base material is coated with a palladium plated layer.

For example, Patent Document 1 (Japanese Patent Application Publication No. 2008-4498 A) discloses, as such a member formed with a palladium plated layer on the surface of a base material, a palladium plate coated material obtained by forming a conductive oxide film on a base material and thereafter forming a palladium plated layer on the conductive oxide film.

SUMMARY OF THE INVENTION

According to the above palladium plate coated material as disclosed in Patent Document 1, however, problems may arise in that, if the thickness of the palladium plated layer at the surface is unduly thin, defects such as pinholes will occur in the palladium plated layer thereby to corrode the base material as a material to be plated, resulting in an increased electrical resistance value (i.e., reduced conductivity), while on the other hand an unduly thick thickness of the palladium plated layer at the surface will lead to disadvantages in cost.

The present invention has been made in consideration of such actual circumstances, and an object of the present invention is to provide a palladium plate coated material which can be improved in the coverage and interfacial adhesion property of the palladium plated layer even when reducing the thickness of the palladium plated layer at the surface, thereby to be excellent in corrosion resistance and conductivity and advantageous in cost.

As a result of intensive studies to achieve the above object, the present inventor and his colleagues have found that the above object can be achieved by forming an underlying alloy layer composed of certain elements on a base material and forming a palladium plated layer on the underlying alloy layer, and the present inventor has accomplished the present invention.

That is, according to an aspect of the present invention, there is provided a palladium plate coated material comprising: a base material; an underlying alloy layer formed on the base material; and a palladium plated layer formed on the underlying alloy layer. The palladium plate coated material is characterized in that the underlying alloy layer is formed of an M1-M2-M3 alloy (where M1 is at least one element selected from Ni, Fe, Co, Cu, Zn and Sn, M2 is at least one element selected from Pd, Re, Pt, Rh, Ag and Ru, and M3 is at least one element selected from P and B).

According to another aspect of the present invention, there is provided a method of producing a palladium plate coated material. The method comprises: a step of forming an underlying alloy layer on a base material by electroless plating; and a step of forming a palladium plated layer on the underlying alloy layer by electroless plating. The method is characterized in that the underlying alloy layer is formed of an M1-M2-M3 alloy (where M1 is at least one element selected from Ni, Fe, Co, Cu, Zn and Sn, M2 is at least one element selected from Pd, Re, Pt, Rh, Ag and Ru, and M3 is at least one element selected from P and B).

According to the present invention, there can be provided a palladium plate coated material which can be improved in the coverage and interfacial adhesion property of the palladium plated layer formed on the base material even when reducing the thickness of the palladium plated layer, thereby to be excellent in corrosion resistance and conductivity and advantageous in cost.

DESCRIPTION OF THE PREFERRED EMBODIMENT

The palladium plate coated material 100 according to the present embodiment will hereinafter be described.

Figure 1:
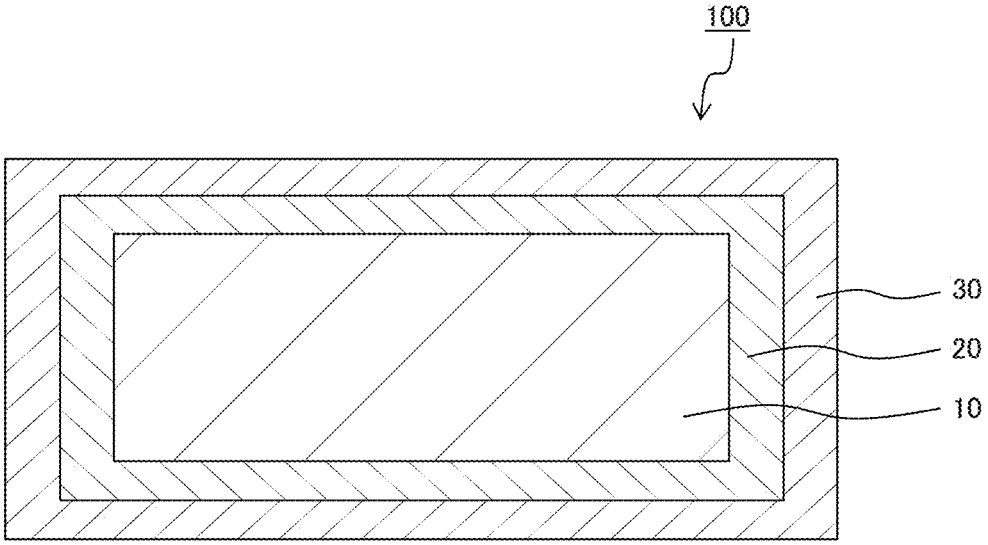
FIG. 1 is a view which shows a structure of a palladium plate coated material 100 according to the present embodiment.

The palladium plate coated material 100 according to the present embodiment comprises, as shown in FIG. 1, an underlying alloy layer 20 and a palladium plated layer 30 on a base material 10, and has a feature that the underlying alloy layer 20 is formed of an M1-M2-M3 alloy (where M1 is at least one element selected from Ni, Fe, Co, Cu, Zn and Sn, M2 is at least one element selected from Pd, Re, Pt, Rh, Ag and Ru, and M3 is at least one element selected from P and B).

<Base Material 10>

The base material 10 is not particularly limited. Examples of the base material 10 include steel, stainless steel, Al, Al alloy, Ti, Ti alloy, Cu, Cu alloy, Ni, and Ni alloy. The shape and form of the base material 10 are not particularly limited, and may be appropriately selected depending on the use. For example, the base material 10 may be used after being worked into a necessary shape or form depending on its use, such as a conductive metal component worked into a linear form or a plate or sheet-like form, a conductive member obtained by working a plate or sheet into an irregular form, and an electronic device component worked into a spring-like or tubular form. The thickness (such as diameter and sheet or plate thickness) of the base material 10 is also not particularly limited, and may be appropriately selected depending on the use.

In the present embodiment, the palladium plate coated material 100 can be used as a separator for fuel cells. Such a separator for fuel cells is used as a member of a fuel cell that constitutes a fuel cell stack, and has a function to supply an electrode with fuel gas or air through gas flow channels and a function to collect electrons generated at the electrode. When the palladium plate coated material 100 is used as a separator for fuel cells, the surface of the base material 10 to be used may be preliminarily formed with irregularities (gas flow channels) that function as flow channels for fuel gas or air. The method of forming such gas flow channels is not particularly limited, but a method of forming the gas flow channels by press working may be mentioned, for example.

<Underlying Alloy Layer 20>

The underlying alloy layer 20, which is an underlying layer for smoothly forming the palladium plated layer 30, comprises an M1-M2-M3 alloy. Here, the M1-M2-M3 alloy is composed of M1, M2 and M3 which are different elements from one another, where M1 is at least one element selected from Ni, Fe, Co, Cu, Zn and Sn, M2 is at least one element selected from Pd, Re, Pt, Rh, Ag and Ru, and M3 is at least one element selected from P and B.

The method of forming the underlying alloy layer 20 is not particularly limited. The underlying alloy layer 20 can be formed by an appropriate method, such as electrolytic plating, electroless plating, and sputtering. As will be described later, it is preferred to form the underlying alloy layer 20 by electroless plating.

M1 in the M1-M2-M3 alloy is at least one element selected from Ni, Fe, Co, Cu, Zn and Sn. One element may be solely used, or two or more elements may be used in combination, such as in Ni—Fe, Ni—Co and Ni—Cu. Each element that constitutes M1 is an element having a property capable of independently forming a plated layer on the base material 10, and has an action to allow the underlying alloy layer 20 to adhere tightly to the base material 10. In view of preventing the plating liquid from self-decomposition and enhancing the stability of the plating liquid, it is preferred to use at least one element selected from Ni and Co as M1, and particularly preferred is to use Ni.

M2 in the M1-M2-M3 alloy is at least one element selected from Pd, Re, Pt, Rh, Ag and Ru. One element may be solely used, or two or more elements may be used in combination. Each element that constitutes M2 is an element having an autocatalytic action, and acts as a catalyst for the reaction of a reductant in the plating bath when deposited on the base material 10, i.e., has an action to continuously progress the metal deposition reaction. In view of keeping low cost, it is preferred to use at least one element selected from Pd and Ag as M2, and particularly preferred is to use Pd.

M3 in the M1-M2-M3 alloy is at least either one element selected from P and B. One element may be solely used, or these elements may be used in combination, as P—B. Each element that constitutes M3 is a metalloid that constitutes a reductant in the plating bath for forming the underlying alloy layer 20, and will be unavoidably incorporated into the underlying alloy layer 20 in general when the underlying alloy layer 20 is formed. In view of preventing the plating liquid from self-decomposition and enhancing the stability of the plating liquid, it is preferred to use P as M3.

The ratio of each element in the M1-M2-M3 alloy may preferably be such that M1 is 15 to 65 at %, M2 is 20 to 60 at %, and M3 is 15 to 40 at %, and more preferably such that M1 is 20 to 50 at %, M2 is 30 to 50 at %, and M3 is 20 to 30 at %. The M1-M2-M3 alloy may slightly contain impurities, which are unavoidably mixed therein, to such an extent that allows the palladium plated layer 30 to be appropriately formed on the M1-M2-M3 alloy. Examples of such unavoidable impurities include a heavy metal, such as Pb, Tl and Bi, which is added as a stabilizer that prevents the plating liquid from self-decomposition and stabilizes the plating liquid. In view of reducing the environmental load, Bi may preferably be used as the stabilizer. According to the feature that the composition ratio of the M1-M2-M3 alloy is adjusted within the above range, the underlying alloy layer 20 may be smoothly formed on the base material 10, and the palladium plated layer 30 formed on the underlying alloy layer 20 can have improved coverage (i.e., a ratio of an area covered by the palladium plated layer 30 to the surface of the underlying alloy layer 20 on which the palladium plated layer 30 is formed) and improved interfacial adhesion property, thereby to be excellent in the corrosion resistance and the conductivity.

Respective elements of the M1-M2-M3 alloy may be arbitrarily combined to be used. In view of preventing the plating liquid from self-decomposition and enhancing the stability of the plating liquid, Ni—Pd—P alloy and Co—Ag—P alloy are preferred, and Ni—Pd—P alloy is particularly preferred.

While the method of forming the underlying alloy layer 20 of the M1-M2-M3 alloy is not particularly limited as described above, when a method of formation by electroless plating is employed, there may be used a plating bath which contains elements represented by M1, M2 and M3 and to which a reductant and a complexing agent are added (underlying alloy electroless plating bath).

For example, when forming the underlying alloy layer 20 of Ni—Pd—P alloy, the underlying alloy electroless plating bath to be used can be obtained by mixing a nickel plating bath and a palladium plating bath which are ordinarily used. Examples of the nickel plating bath include a plating bath that contains: a nickel salt such as nickel chloride, nickel sulfate, nickel nitrate and nickel acetate; a phosphorus-containing reductant such as hypophosphite; and a complexing agent such as citric acid. Examples of the palladium plating bath include a plating bath that contains: a palladium salt such as palladium chloride; a phosphorus-containing reductant such as hypophosphite and phosphite; and a complexing agent such as thiodiglycolic acid.

When the nickel plating bath and the palladium plating bath are mixed to prepare the underlying alloy electroless plating bath, it is preferred that nickel chloride is used as the nickel salt and palladium chloride is used as the palladium salt. Mixing ratio of the nickel plating bath and the palladium plating bath may appropriately be set in accordance with the ratio of respective elements that constitute the Ni—Pd—P alloy. The above exemplifies the case in which the underlying alloy layer 20 is formed of Ni—Pd—P alloy, but also in the case in which the underlying alloy layer 20 is formed of other alloy than Ni—Pd—P alloy, there may be used an underlying alloy electroless plating bath obtained in a similar manner by appropriately adjusting a plating bath which contains respective elements of M1, M2 and M3 and to which a reductant and a complexing agent are added.

It is preferred that the underlying alloy layer 20 is formed using the above-described underlying alloy electroless plating bath under a condition of pH of 4.0 to 7.0, a bath temperature of 30° C. to 50° C., and an immersion time of 5 to 20 minutes.

The thickness of the underlying alloy layer 20 to be formed may preferably be 5 to 100 nm, and more preferably 30 to 50 nm. The thickness of the underlying alloy layer 20 being within the above range allows the palladium plated layer 30 to be smoothly formed on the underlying alloy layer 20.

Here, when the palladium plate coated material 100 according to the present embodiment is used as a separator for fuel cells, the base material 10 on which such an underlying alloy layer 20 is to be formed may be preliminarily formed with gas flow channels such as by press working, as described above. According to the present embodiment, the underlying alloy layer 20 can be formed on such a base material 10, which is preliminarily formed with gas flow channels, thereby to effectively prevent cracks in the underlying alloy layer 20 of the separator for fuel cells to be obtained. This will be described in more detail. When the underlying alloy layer 20 is formed on a base material 10 on which gas flow channels are not formed and thereafter the gas flow channels are formed such as by press working, a problem may arise in that cracks occur in the underlying alloy layer 20 due to stresses applied when the gas flow channels are formed. However, such a problem can be solved by preliminarily forming the gas flow channels on the base material 10 and thereafter forming the underlying alloy layer 20 as described above. In particular, according to the present embodiment, when the underlying alloy layer 20 is formed by electroless plating, the underlying alloy layer 20 can be uniformly formed for the gas flow channel part having irregularities while suppressing the occurrence of unformed parts of the underlying alloy layer 20.

In the present embodiment, the underlying alloy layer 20 may be formed directly on the base material 10, but a modifying layer may be provided between the base material 10 and the underlying alloy layer 20 in order to enhance the interfacial adhesion property of the underlying alloy layer 20. The modifying layer may appropriately be formed in accordance with properties of the base material 10 and the underlying alloy layer 20. In view of enhancing the interfacial adhesion property with the underlying alloy layer 10, the modifying layer may preferably be a layer that contains the same element or elements as M1 of the M1-M2-M3 alloy which constitutes the underlying alloy layer 20. For example, when Ni—Pd—P alloy is employed as the underlying alloy layer 20, the modifying layer may preferably be a Ni-based layer that contains Ni as the element represented by M1. When such a Ni-based layer is formed by electroless reduction plating, the Ni-based layer may be a Ni—P plated layer. One modifying layer may be provided, or two or more modifying layers may also be provided. When two or more modifying layers are provided, components that constitute respective layers may be or may not be the same. The method of forming the modifying layer or layers is not particularly limited. The modifying layer or layers can be formed by an appropriate method such as electrolytic plating, electroless plating, and sputtering.

<Palladium Plated Layer 30>

The palladium plated layer 30 is a layer that is formed by performing a palladium plating process on the underlying alloy layer 20. The plating method of forming the palladium plated layer 30 is not particularly limited, but it is preferred to form the palladium plated layer 30 by electroless plating.

The palladium plating bath to be used when forming the palladium plated layer 30 by electroless plating is not particularly limited. For example, there can be used a plating bath that contains: palladium chloride as the palladium salt; and hypophosphite, phosphite or formate as the reductant. As will be understood, when hypophosphite or phosphite is used as the reductant, the palladium plated layer 30 formed will contain a small amount of phosphorus.

When the palladium plated layer 30 is formed by electroless plating, it is preferred to use a palladium plating bath to form the palladium plated layer 30 under a condition of pH of 5.5 to 7.0 and a bath temperature of 55° C. to 72° C. The immersion time into the palladium plating bath when forming the palladium plated layer 30 is not particularly limited, and can be set in accordance with the necessary film thickness of the palladium plated layer 30.

The thickness of the palladium plated layer 30 may preferably be 2 to 20 nm, and more preferably 5 to 10 nm. If the thickness of the palladium plated layer 30 is unduly thin, the palladium plated layer 30 will not be uniformly formed on the underlying alloy layer 20, so that the corrosion resistance, conductivity and soldering property may possibly deteriorate when the palladium plated layer 30 is used as a part of the palladium plate coated material 100. On the other hand, unduly thick thickness of the palladium plated layer 30 may lead to disadvantages in cost.

The palladium plate coated material 100 according to the present embodiment is configured such that the underlying alloy layer 20 composed of the M1-M2-M3 alloy is formed on the base material 10 and the palladium plated layer 30 is formed on the underlying alloy layer 20, and it is thereby possible to improve the coverage and interfacial adhesion property of the palladium plated layer 30. Thus, the palladium plate coated material 100 of the present embodiment has improved coverage and interfacial adhesion property of the palladium plated layer 30 even when reducing the thickness of the palladium plated layer 30 at the surface. This allows the palladium plate coated material 100 to be excellent in corrosion resistance and conductivity and advantageous in cost, and the palladium plate coated material 100 may be suitably used as an electrical contact material such as used for connectors, switches or printed wiring boards.

As a method of producing a palladium plate coated material formed with a palladium plated layer at the surface, there has conventionally been used a method of forming a palladium plated layer by performing a palladium plating process directly on a base material. In such a method, however, if the palladium plated layer is formed to be thin, the coverage of the palladium plated layer to the base material will be reduced to cause the base material to readily corrode. If, on the other hand, the palladium plated layer is formed to be thick, a large amount of expensive palladium will have to be used, leading to disadvantages in cost, which may be problematic.

In particular, a separator for fuel cells is exposed to an environment of high temperature and acidic atmosphere in the fuel cells. Therefore, when the palladium plate coated material is used as a separator for fuel cells, if the coverage of the palladium plated layer at the surface is low, corrosion of the base material will progress rapidly. This may result in a problem in that the electrical resistance value increases due to the corrosion product generated on the surface of the base material to deteriorate the function as a separator for fuel cells, i.e., the function of collecting electrons generated at the electrode.

In contrast, the palladium plate coated material 100 according to the present embodiment is configured such that the layer of the M1-M2-M3 alloy is formed as the underlying alloy layer 20 thereby to allow the palladium plated layer 30 having excellent coverage and interfacial adhesion property to be formed on the underlying alloy layer 20. According to the present embodiment, therefore, even when the thickness of the palladium plated layer 30 is thin, the palladium plate coated material 100 obtained can have excellent corrosion resistance and conductivity and can be advantageous in cost, which may be suitably used as a separator for fuel cells.

EXAMPLES

Hereinafter, the present invention will be more specifically described with reference to examples, but the present invention is not limited to these examples.

Example 1

First, a stainless steel material (SUS316L) was prepared as a base material 10. Then, for the prepared base material 10, electroless plating was performed using a plating bath under a condition of 35° C. and 3 minutes to form a Ni—Pd—P alloy layer of a thickness of 40 nm as an underlying alloy layer 20 on the base material 10. The plating bath was obtained by mixing a palladium plating bath and a nickel plating bath as below at a ratio of (palladium plating bath):(nickel plating bath)=3:1 (volume ratio). With regard to the palladium salt, reductant and complexing agent in the plating bath, conventionally-known compounds were used.

<Palladium Plating Bath>

Palladium salt: An amount as Pd amount of 0.15 wt % in the palladium plating bath Reductant: 1.8 wt %

Complexing agent: 0.63 wt %

Water: 97.2 wt % pH: 5.5

<Nickel Plating Bath>

Nickel salt (nickel chloride): 1.8 wt %

Reductant (sodium hypophosphite): 2.4 wt %

Complexing agent: 2.4 wt %

Water: 93.2 wt % pH: 5.5

Next, for the base material 10 formed with the Ni—Pd—P alloy layer, electroless plating was performed using the above palladium plating bath under a condition of 60° C. and 1 minute to form a palladium plated layer 30 of a thickness of 6.2 nm on the Ni—Pd—P alloy layer, and a palladium plate coated material 100 was thus obtained.

Measurement of Coverage of Palladium Plated Layer 30

Figure 2:
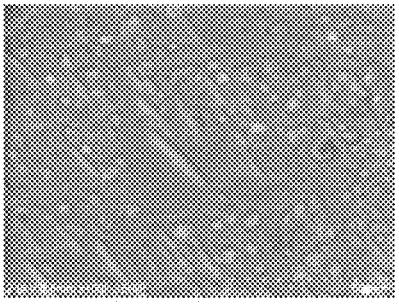
FIG. 2 is a set of SEM images of the surfaces of palladium plate coated materials 100 obtained in the examples.
Figure 2:
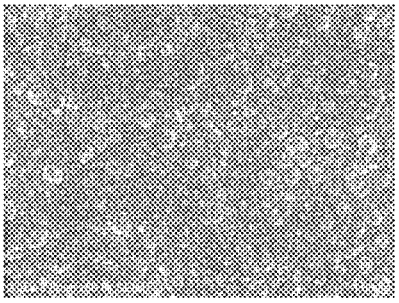
Figure 2:
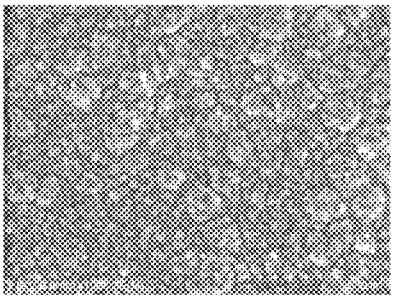
Figure 2:
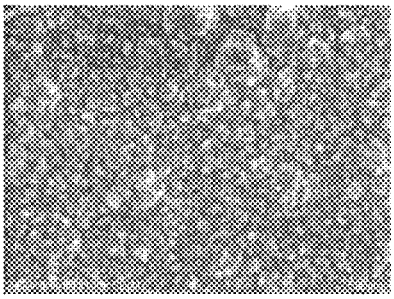
Figure 2:
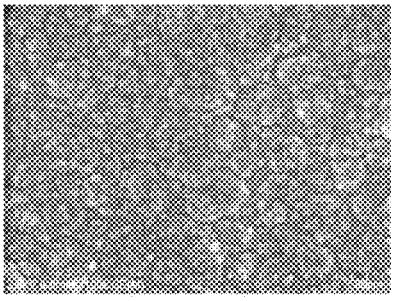

The surface of the palladium plate coated material 100 thus obtained was observed using a scanning-type electron microscope SEM (S-4800 available from Hitachi High-Technologies Corporation), and the coverage of the palladium plated layer 30 at the surface of the palladium plate coated material 100 was measured based on the obtained SEM image. Measurement of the coverage of the palladium plated layer 30 was performed by binarizing the above SEM image using a brightness threshold determined such that the defects such as pinholes in the palladium plated layer 30 would be able to be specified, and thereafter, based on the binarized image, calculating the ratio of an area formed with the palladium plated layer 30. Measurement results of the coverage are listed in Table 1. FIG. 2(A) shows a SEM image of the surface captured after forming the Ni—Pd—P alloy layer on the base material 10 but before forming the palladium plated layer 30 in the palladium plate coated material 100 according to the present example, and FIG. 2(B) shows a SEM image of the surface captured after forming the palladium plated layer 30.

Examples 2 to 4

Palladium plate coated materials 100 were obtained in the same manner as in Example 1 except that the condition such as immersion time in the electroless plating for forming the palladium plated layers 30 was changed so that the thicknesses of the palladium plated layers 30 to be formed would be 8.8 nm (Example 2), 13.3 nm (Example 3), and 21.5 nm (Example 4), and the coverage of the palladium plated layers 30 was measured in the same manner. Measurement results of the coverage are listed in Table 1. FIG. 2(C), FIG. 2(D), and FIG. 2(E) show the SEM images of the surfaces of the palladium plate coated materials 100 according to Examples 2 to 4, respectively.

TABLE 1

| | Palladium plated layer | |
|---|---|---|
| | Thickness [nm] | Coverage [%] |
| Example 1 | 6.2 | 99.89 |
| Example 2 | 8.8 | 100 |
| Example 3 | 13.3 | 100 |
| Example 4 | 21.5 | 100 |

It has been confirmed from the results of Table 1, FIG. 2(B), FIG. 2(C), FIG. 2(D), and FIG. 2(E) that each of Examples 1 to 4, in which the underlying alloy layer 20 is formed on the base material 10 and the palladium plated layer 30 is formed on the underlying alloy layer 20, has high coverage of the palladium plated layer 30 even when the thickness thereof is thin, e.g., about several nanometers, thereby to prevent the occurrence of delamination triggered from undeposited parts in the palladium plating, such as pinholes, and to have excellent interfacial adhesion property of the palladium plate layer 30.

Example 5

A palladium plate coated material 100 was obtained in the same manner as in Example 1 except that: the condition such as mixing ratio of the palladium plating bath and nickel plating bath for forming the underlying alloy layer 20 was changed so that the thickness of the Ni—Pd—P alloy layer to be formed would be 40 nm and the composition would be Ni:Pd:P=34:42:20 (at %) and unavoidable impurities; and the condition such as immersion time in the electroless plating for forming the palladium plated layer 30 was changed so that the thickness of the palladium plated layer 30 to be formed would be 8.9 nm. The composition of the underlying alloy layer 20 was measured using an inductively coupled plasma emission spectrometer (ICPE-9000 available from SHIMADZU CORPORATION).

Example 6

A palladium plate coated material 100 was obtained in the same manner as in Example 5 except that: the condition such as mixing ratio of the palladium plating bath and nickel plating bath for forming the underlying alloy layer 20 was changed so that the thickness of the Ni—Pd—P alloy layer to be formed would be 44 nm and the composition would be Ni:Pd:P=62:23:15 (at %) and unavoidable impurities; and the condition such as immersion time in the electroless plating for forming the palladium plated layer 30 was changed so that the thickness of the palladium plated layer 30 to be formed would be 7.4 nm.

Evaluation of Corrosion Resistance

For the palladium plate coated materials 100 obtained in Examples 5 and 6, evaluation of corrosion resistance was conducted. Specifically, the evaluation of corrosion resistance was performed through: masking each palladium plate coated material 100 with a polyimide tape to expose a surface area of 35 mm longitudinal and 20 mm lateral; immersing the palladium plate coated material 100 in a sulfuric acid aqueous solution of 90° C. (volume: 80 ml, pH: 1.0) for 100 hours; thereafter taking out the palladium plate coated material 100; and measuring a mass concentration (g/L) of ions (Ni, Pd, P, Fe, Cr, and Mo) dissolved from the palladium plate coated material 100 into the sulfuric acid aqueous solution using an inductively coupled plasma emission spectrometer (ICPE-9000 available from SHIMADZU CORPORATION). For comparison, a stainless steel material (SUS316L) ordinarily used as a material for a separator for fuel cells was also immersed in a sulfuric acid aqueous solution in the same manner, and a mass concentration (g/L) of ions (Fe, Cr, Mo, and Ni) dissolved into the sulfuric acid aqueous solution was measured to evaluate the corrosion resistance. Results are shown in FIG. 3.

Figure 3:
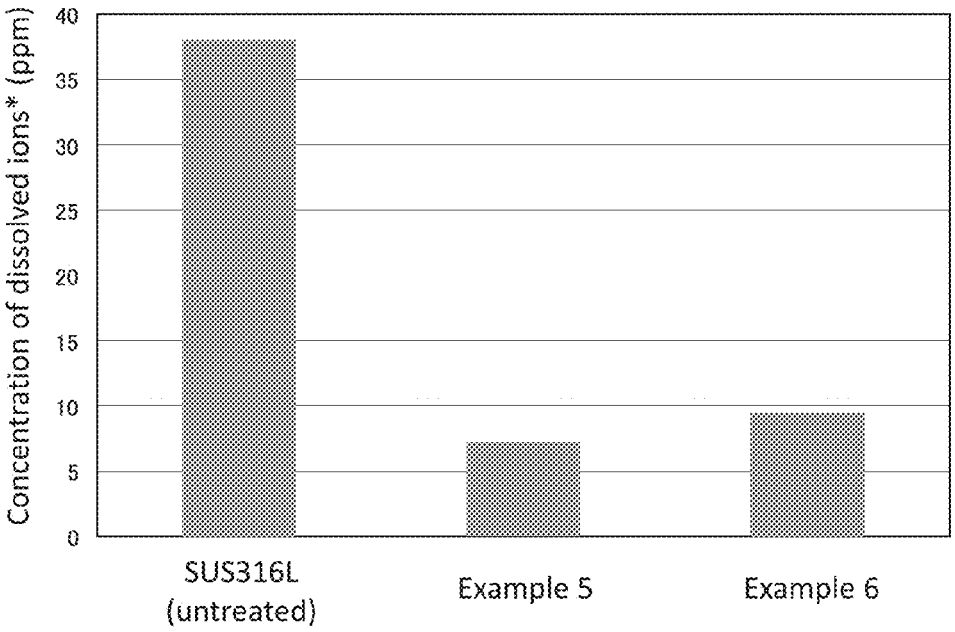
FIG. 3 is a graph which shows results when the corrosion resistance was evaluated for palladium plate coated materials 100 obtained in the examples.

In the graph shown in FIG. 3, the evaluation results in Examples 5 and 6 represent the mass concentrations of ions of Ni, Pd, P, Fe, Cr, and Mo dissolved from the palladium plate coated material 100, while the evaluation result of SUS316L represents the mass concentration of ions of Fe, Cr, Mo, and Ni dissolved from SUS316L.

It has been confirmed from the results of FIG. 3 that each of Examples 5 and 6, in which the Ni—Pd—P alloy layer as the underlying alloy layer 20 is formed on the base material 10 and the palladium plated layer 30 is formed on the underlying alloy layer 20, can effectively suppress the dissolution of ions from the base material and thus has excellent corrosion resistance compared with SUS316L used as a conventional material for a separator for fuel cells, etc., even when the thickness of the palladium plated layer 30 is thin, e.g., about several nanometers.

Measurement of Contact Resistance Value

Figure 4:
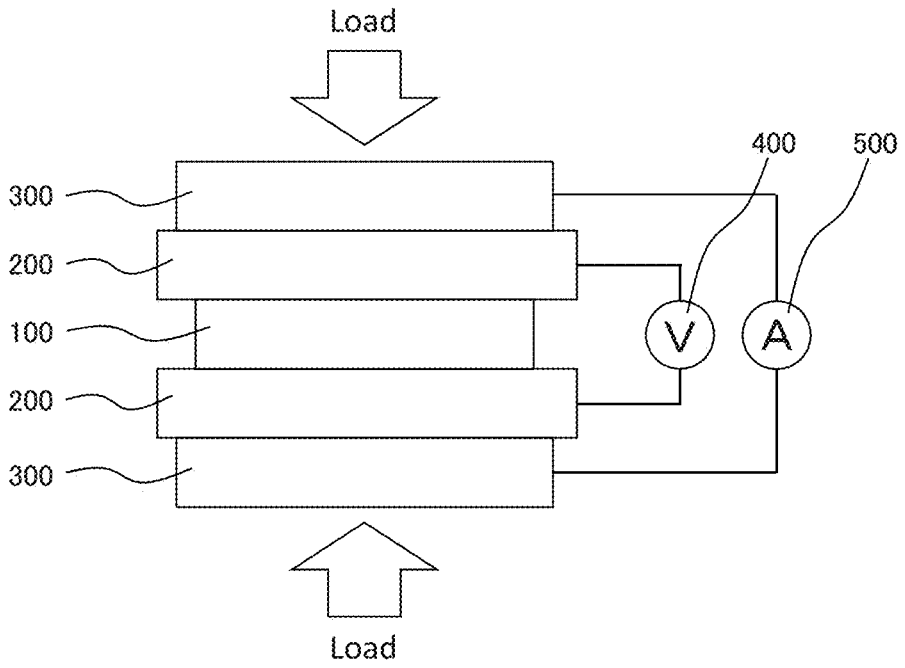
FIG. 4 is a diagram for explaining a method of measuring a contact resistance of palladium plate coated materials 100 obtained in the examples.

Each of the palladium plate coated materials 100 obtained in Examples 5 and 6 was used to form a measurement system as shown in FIG. 4, and measurement of the contact resistance value was performed using the measurement system formed. The measurement system shown in FIG. 4 is configured of: the palladium plate coated material 100; carbon cloths 200, which are used as base materials of gas diffusion layers in a separator for fuel cells; gold plate coated copper electrodes 300; a voltmeter 400; and an ammeter 500. Specifically, at the time of measurement of the contact resistance value, the palladium plate coated material 100 was first worked into a size of width of 20 mm, length of 20 mm and thickness of 1.27 mm and fixed by being interposed between the gold plate coated copper electrodes 300 via the carbon cloths 200 (part number: TGP-H-090, available from Toray Industries, Inc), and the measurement system was thus formed as shown in FIG. 4. Then, the contact resistance values between the upper and lower carbon cloths 200 sandwiching the test piece were measured using an ohm meter (Milli-Ohm HiTESTER 3540 available from HIOKI E.E. CORPORATION) within a range of load of 5 to 20 ($kg/cm^2$) while applying a constant load to the copper electrodes 300. Measurement results are shown in FIG. 5.

Figure 5:
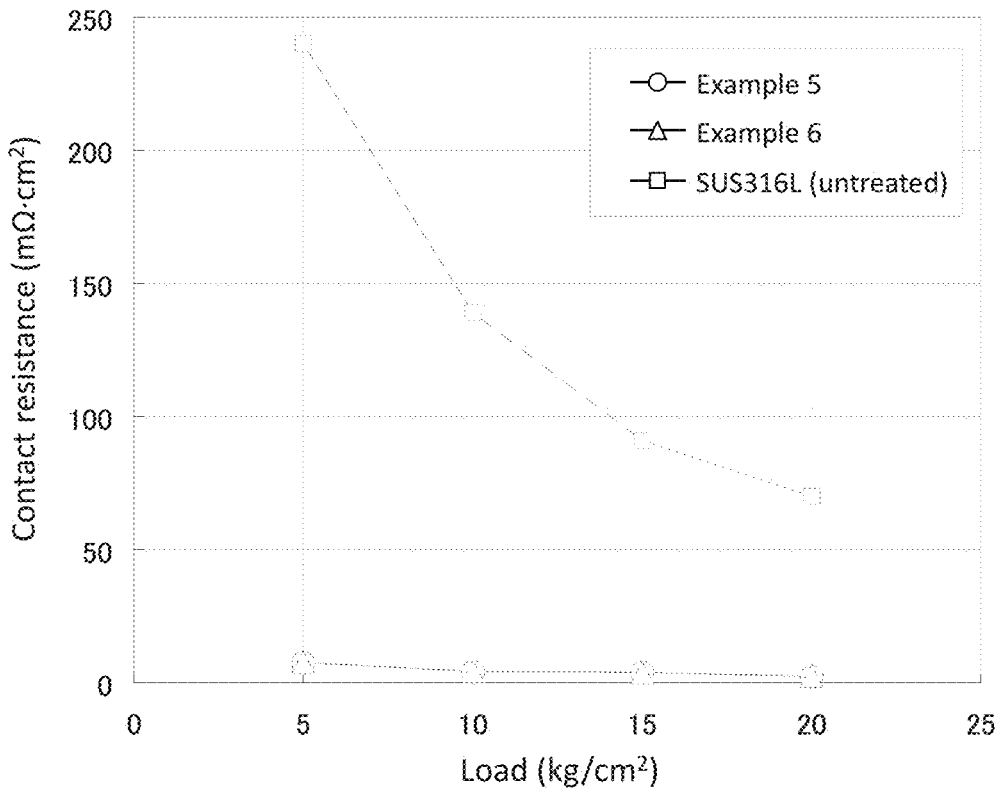
FIG. 5 is a graph which shows results when the contact resistance was measured for palladium plate coated materials 100 obtained in the examples.

FIG. 5 also shows values of the measured contact resistance values of SUS316L as comparative data. The contact resistance values of SUS316L were obtained by performing measurement in the above-described measurement system as shown in FIG. 4 after working SUS316L into a size of width of 20 mm, length of 20 mm and thickness of 1.0 mm.

It has been found from the results of FIG. 5 that each of Examples 5 and 6, in which the underlying alloy layer 20 is formed on the base material 10 and the palladium plated layer 30 is formed on the underlying alloy layer 20, exhibits a lower contact resistance value at any load value and thus has excellent conductivity compared with SUS316L used as a conventional material for a separator for fuel cells, etc.

DESCRIPTION OF REFERENCE NUMERALS

100 . . . Palladium plate coated material
10 . . . Base material
20 . . . Underlying alloy layer
30 . . . Palladium plated layer

What is claimed is:

1. A palladium plate coated material comprising:
a base material formed of a metal selected from steel, stainless steel, Al, Al alloy, Ti, Ti alloy, Cu, Cu alloy, Ni, or Ni alloy;
an underlying alloy layer formed on the base material; and
a palladium plated layer formed on the underlying alloy layer,
wherein the underlying alloy layer is formed of an M1-M2-M3 ternary alloy,
wherein M1 is Ni, M2 is Pd, and M3 is P,
wherein, in the M1-M2-M3 ternary alloy, a ratio of M1 is 15 at. % to 65 at. %, a ratio of M2 is 20 at. % to 60 at. %, and a ratio of M3 is 15 at. % to 40 at. %, and
wherein a thickness of the underlying alloy layer is 5 to 100 nm.

2. The palladium plate coated material as set forth in claim 1, further comprising a modifying layer between the base material and the underlying alloy layer to enhance the interfacial adhesion property between the base material and the underlying alloy layer.

3. The palladium plate coated material as set forth in claim 1, wherein a thickness of the palladium plated layer is 2 to 21.5 nm.

4. An electrical contact material having the palladium plate coated material as set forth in claim 1.

5. The palladium plate coated material as set forth in claim 1, wherein a ratio of each element in the M1-M2-M3 ternary alloy is that M1 is 15 to 65 at. %, M2 is 20 to 42 at. %, and M3 is 15 to 40 at. %.

6. A separator for fuel cells having the palladium plate coated material as set forth in claim 1, wherein the base material is formed with gas flow channels having irregularities.

7. A method of producing a palladium plate coated material according to claim 1, the method comprising:
forming an underlying alloy layer on a base material by electroless plating; and
forming a palladium plated layer on the underlying alloy layer by electroless plating, wherein
the underlying alloy layer is formed of an M1-M2-M3 alloy and
M1 is Ni, M2 is Pd, and M3 is P.

* * * * *